US005666992A

United States Patent [19]

Robins

[11] Patent Number: 5,666,992

[45] Date of Patent: Sep. 16, 1997

[54] AIR HOSE REEL

[75] Inventor: Terry K. Robins, Minneapolis, Kans.

[73] Assignee: Lisle Corporation, Clarinda, Iowa

[21] Appl. No.: 590,390

[22] Filed: Jan. 25, 1996

[51] Int. Cl.[6] ..... B65H 75/48

[52] U.S. Cl. ..... 137/355.23; 137/355.27; 242/405.3; 242/407

[58] Field of Search ..... 242/399, 404, 242/404.2, 406, 407, 405.3; 137/355.26, 355.27, 355.23

[56] References Cited

U.S. PATENT DOCUMENTS

| | | | |
|---|---|---|---|
| 446,884 | 5/1891 | Rader, Jr. | 137/355.23 |
| 2,047,705 | 7/1936 | Porter | 242/405.3 |
| 2,635,008 | 4/1953 | Nelson | 242/407 |
| 3,433,247 | 3/1969 | Haselden | 137/355.26 |
| 4,137,939 | 2/1979 | Chow | 137/355.27 |
| 4,311,165 | 1/1982 | Rose, Jr. | 137/355.12 |
| 4,537,215 | 8/1985 | Roman | 137/355.26 |
| 5,381,820 | 1/1995 | Chandler | 137/355.23 |

*Primary Examiner*—A. Michael Chambers
*Attorney, Agent, or Firm*—Robert K. Rhea

[57] ABSTRACT

An air hose reel is formed by an upright L-shaped support horizontally journaling an axle having reel forming spokes secured to one end portion for angular rotation in a vertical plane. A tension spring and friction washers surround the axle for retarding free wheeling movement of the reel. Couplings at respective ends of the axle are connected with air hose.

5 Claims, 3 Drawing Sheets

AIR HOSE REEL

BACKGROUND OF THE INVENTION

1. Field of the Invention

This invention relates to compressed air equipment and more particularly to an air hose reel for winding up and paying out an air hose having greater than atmospheric pressure.

A compressed air hose is usually considered a necessary part of an automotive service shop in the interest of personnel safety, as well as maximizing the useful light of an air hose. It is desirable for having a reel for winding up the hose in an out-of-the-way and yet readily accessible position. This invention accomplishes this purpose.

2. Description of the Prior Art

U.S. Pat. No. 5,381,820 issued Jan. 17, 1995 to Chandler for Hose Reel Apparatus discloses an inverted U-shape bracket mounted the handle of a portable air compressor which horizontally journals a reel between the legs of the U-shape bracket. The bight portion of the U-shape bracket forms a guide track for guiding a hose when wound on the reel to form multiple layers of juxtaposed convolutions of the hose.

U.S. Pat. No. 4,311,165 issued Jan. 19, 1982 to Rose, Jr. for Hose Reel Automatic Rake, discloses a hose wound on a reel journaled on a horizontal axis which includes a brake mechanism energized by opening the exit end of the hose so that fluid pressure in the hose also energizes a brake to stop the uncoiling action of the hose from the reel.

U.S. Pat. No. 4,137,939 issued Feb. 6, 1979 to Chow for Hose Reel Cart, and U.S. Pat. No. 4,537,215 issued Aug. 27, 1985 to Roman for Portable Winding Device for Flexible Pipe, particularly for cars, caravans, coaches, crafts, balconies and small gardens, are believed good examples of the further state-of-the-art. The Chow patent mounts a cylindrical reel on a two-wheel cart manually supported by a handle forming a portable hose reel cart. The Roman patent discloses a fixed casing which rotatably supports a drum around which a hose is manually wound on or payed out from.

This invention is believed distinctive over the above named patents by providing an open framework type reel and support which is simple in operation and ease of construction, and contains a minimum of moving parts which will not easily get out of order and provides a long useful life as an air hose reel.

SUMMARY OF THE INVENTION

A pair of spokes disposed in crossed relation and having U-shaped end portions disposed in 90° radial relation forms a reel supported in cantilever fashion on one end of a horizontal shaft journaled by an upright bracket removably secured to a base. A handle on one of the reel spokes winds up an air hose on the reel.

The principal object of this invention is to provide a pneumatic hose reel easily mounted in any convenient location for manually winding up and paying out the working end of an air hose.

DESCRIPTION OF THE PREFERRED EMBODIMENT

Figure 1:
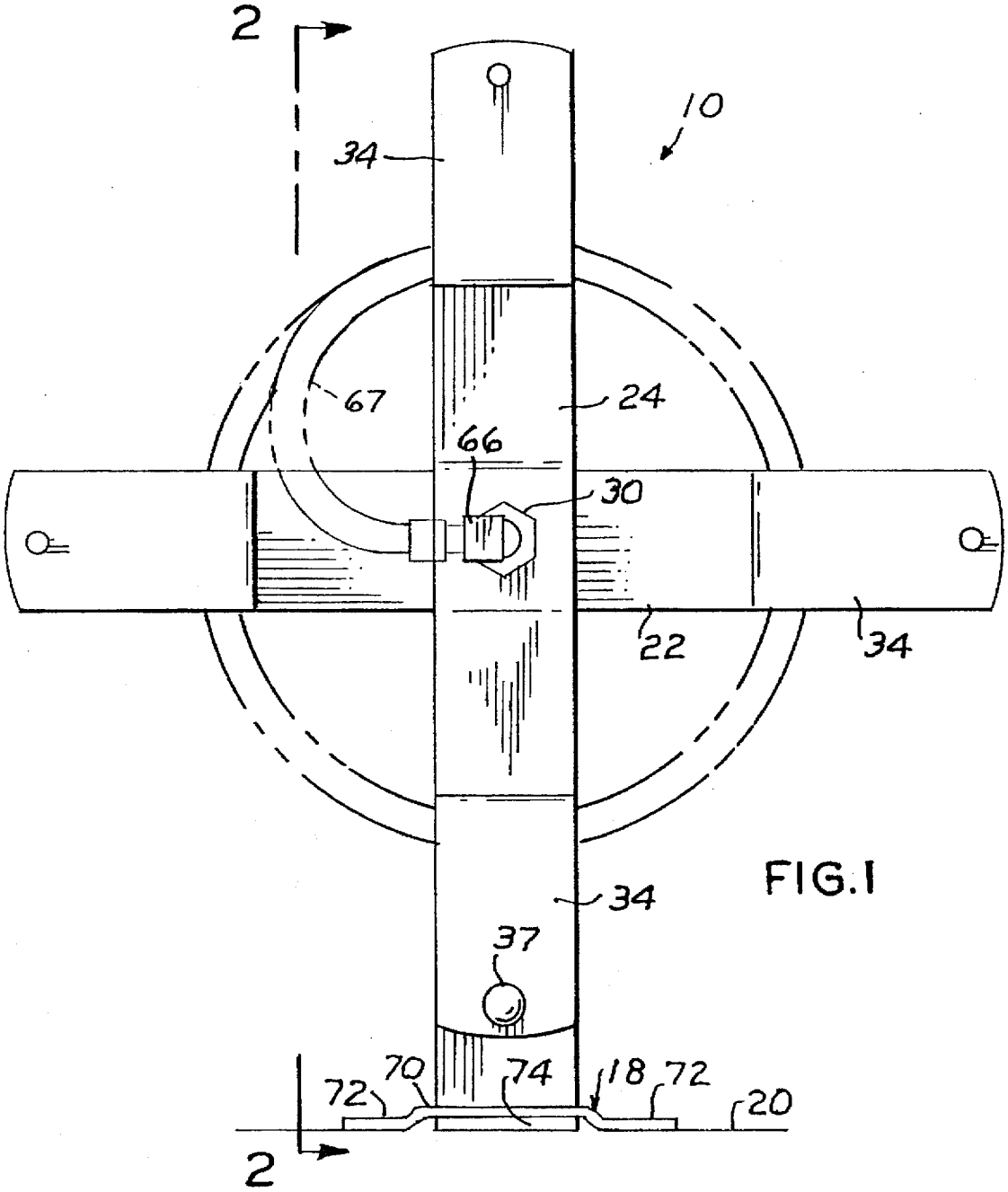
FIG. 1 is a front elevational view.
Figure 2:
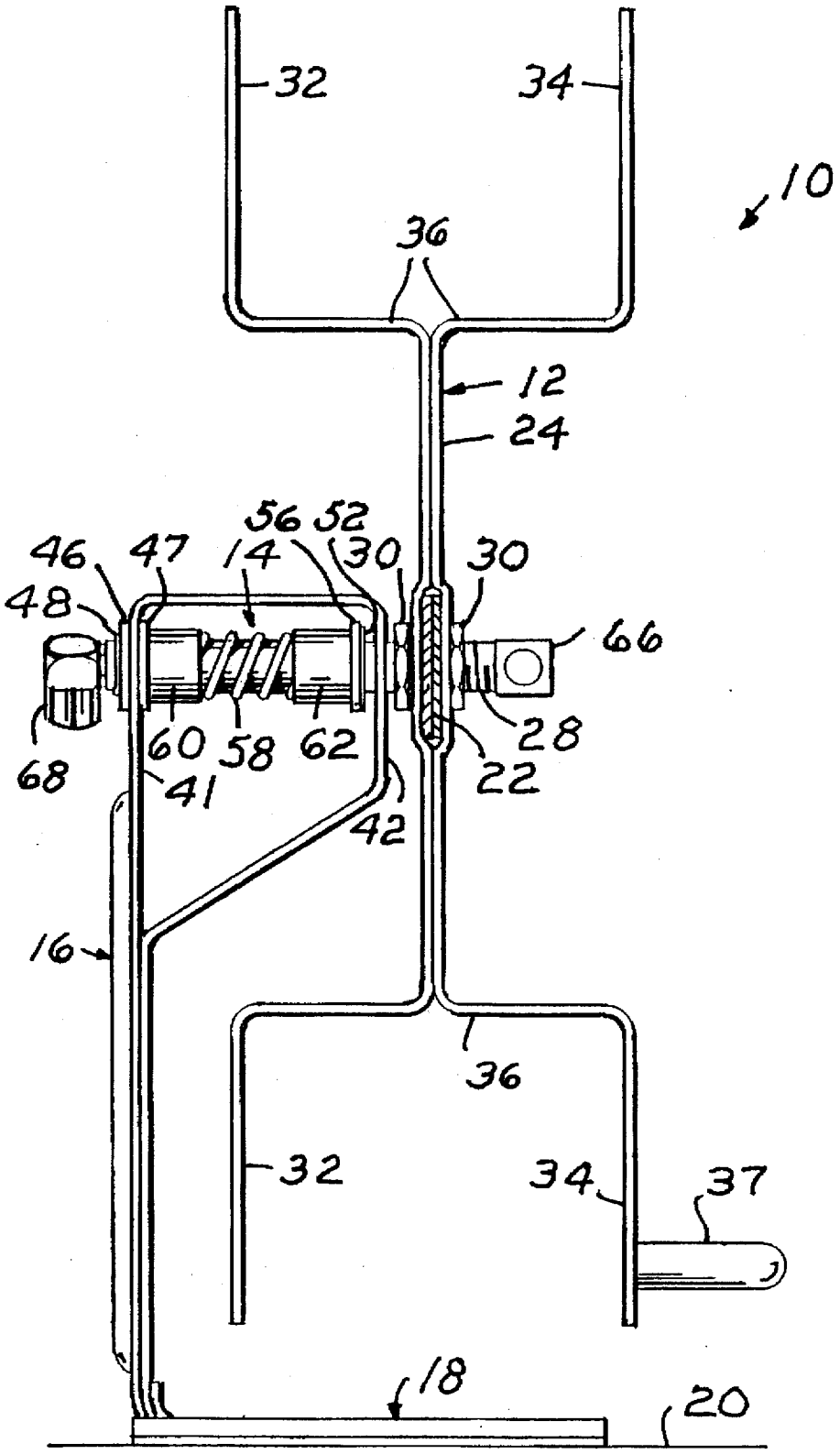
FIG. 2 is a left side elevational view partially in section looking in the direction of the arrows 2—2 of FIG. 1; and, FIG. 3 is an exploded perspective view.

Like characters of reference designate like parts in those figures of the drawings in which they occur.

In the drawings:

The reference numeral 10 indicates the hose reel which comprises a reel means 12 supported in cantilever fashion on one end portion of a horizontal axle means 14 journaled at its other end portion by a bracket 16 removably supported by a base 18 secured to a horizontal support surface 20.

The reel means 12 comprises a pair of strap irons 22 and 24 disposed flatly in orthogonal relation and transversely bored at their junction, as at 26, for receiving one end portion of the axle means axle 28. A pair of lock nuts 30 and a lock washer 31 secure the reel means 12 to the external threads 29 of the axle 28. The respective end of each spoke 22 and 24 is bifurcated to form an outwardly open U-shape defined by a pair of legs 32 and 34 and a bight portion 36. An outstanding handle 37 is secured to one of the legs 34 for manually rotating the reel.

The bracket means 16 is similarly formed from strap iron material doubled back upon itself in flat contiguous relation to form an upright L-shaped as seen in side elevation with its foot portion 38 horizontally disposed and received by the base 18 with its vertical leg portion 40 defining a bracket loop formed by separating the strap iron to form a single thickness upper leg end portion 41 and a parallel relatively short wall 42 overhanging the foot portion 38 in parallel spaced relation with respect to the single thickness leg end portion 41. The single thickness leg end portion 41 and short wall 42 are horizontally line drilled, as at 44 and 45, for journaling the end portion of the axle means axle 28 opposite its externally threaded end portion 29.

A pair of friction washers 46 and 47 surround the axle end portion 28 opposite its external threads and on opposite sides of the leg end portion 41. A retainer clip 48 entering an axle groove 50 at its end portion opposite the external threads maintains the axle journalled by the bracket aperture 44.

An E-clip 52 is disposed in a second axle groove 54 adjacent the short wall 42. A third friction washer 56 surrounds the axle adjacent the E-clip on its side opposite the short wall 42. A tension spring 58 having end cups 60 and 62 nesting its respective end portions, is interposed between the friction washers 47 and 56 around the axle 28. The tension spring 58 maintains constant frictional contact with opposite sides of the leg portion 41 by the friction washers 46 and 47 which impedes free wheeling angular rotation of the reel means 12 about the axis of the axle 28, and yet permits manual rotation of the reel means 12 by the handle 37 for winding up or paying out a hose by manually pulling on its free end.

The axle 28 is further characterized by internal threads at its respective end portions as at 64, only one being shown. A street ell 66 is secured to the axle at its externally threaded end portion for connection with one end of an air hose 67 supported by the reel means 12. Similarly, a conventional right angular swivel 68 is threadedly connected with the internal threads 64 at the other end portion of the axle for connection with a source of compressed air, not shown.

Figure 3:
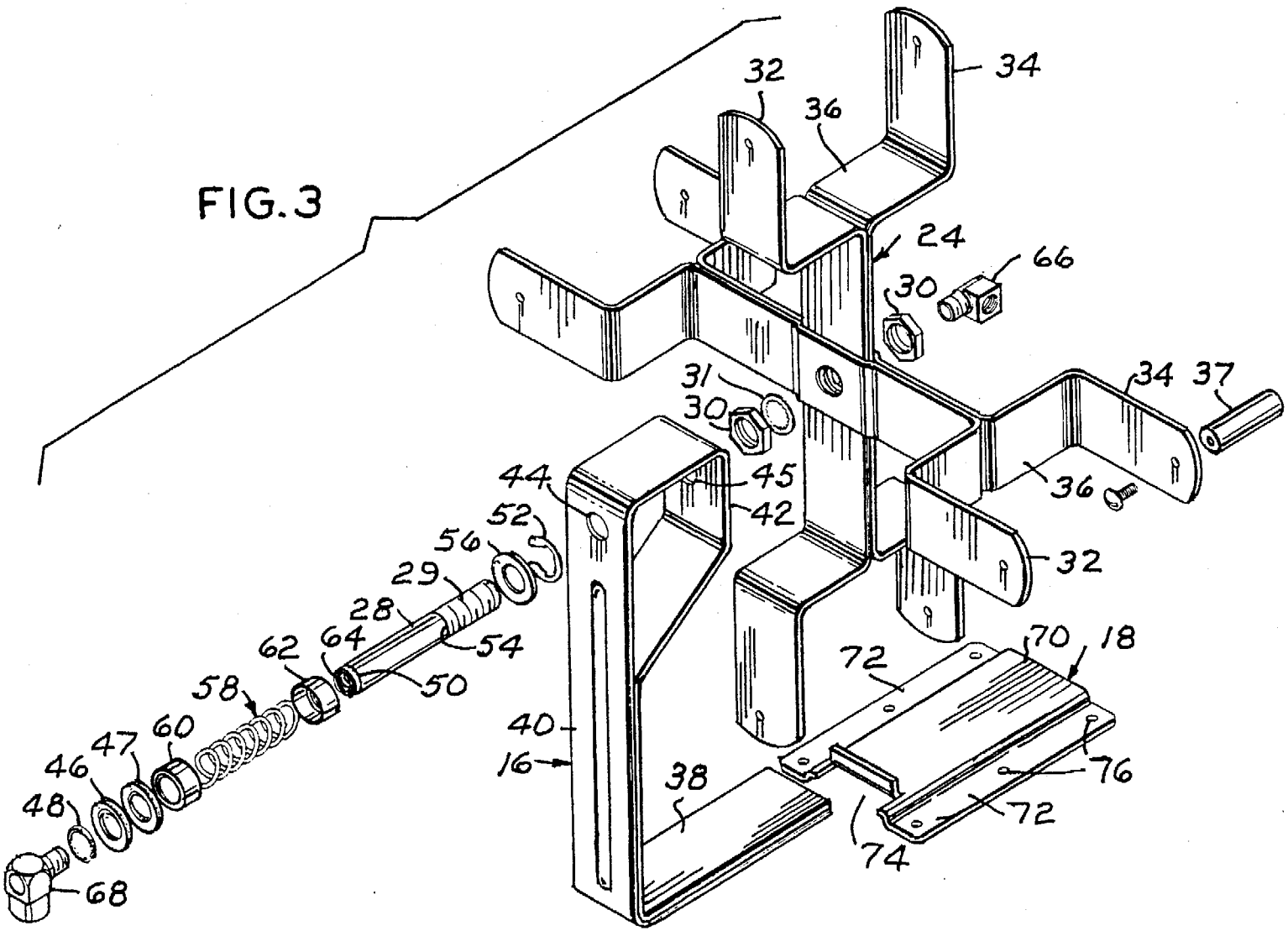

As viewed in FIG. 3, the base is rectangular plate-like in general configuration having its central longitudinal portion struck upwardly to form a bridge 70 between its lateral edge portions 72 with one end portion of the bridge arcuately turned upward to define a recess 74 between the bridge 70 and the support surface 20 which slidably receives the foot portion 38 of the bracket means 16. The base lateral edge portions 72 are apertured as at 76 for anchoring the base to the support surface 20.

Obviously the invention is susceptible to changes or alterations without defeating its practicability. Therefore, I do not wish to be confined to the preferred embodiment shown in the drawings and described herein.

I claim:

1. An air hose reel apparatus, comprising;

a base having a recess;

a L-shaped support having spaced-apart walls at one end portion and having a foot portion at its other end removably received by the base recess;

tubular axle means journaled by and projecting, at its respective ends, beyond said walls;

reel means including angularly spaced spokes secured to one end portion of said axle for angular rotation in a vertical plane when winding up or paying out an air hose;

a first clip secured to the end portion of said axle projecting beyond said wall opposite said reel means;

a second clip secured to an intermediate portion of said axle adjacent but spaced from the wall adjacent said reel means;

a pair of friction washers respectively surrounding said axle on opposite sides of said wall opposite said reel means;

tension spring means surrounding said axle between said second clip and the adjacent said friction washer of said pair of friction washers for axially biasing said axle in the direction of said reel means and each washer of said pair of friction washers against opposite sides of said wall opposite said reel means for constant frictional resistance to free wheeling angular rotation of said axle and said reel means as a unit; and, coupling means secured to respective end portions of said axle for connection with a source of air under greater than atmospheric pressure.

2. The hose reel apparatus according to claim 1 in which the reel means spoke end portions opposite said axle are bifurcated and define an outwardly open U-shape disposed transversely of the reel means vertical plane of rotation.

3. The hose reel apparatus according to claim 2 in which the coupling means includes:

a street ell; and, a swivel coupling.

4. The hose reel apparatus according to claim 1 in which said tension spring means further includes:

a pair of tension spring end caps surrounding said axle and respective end portions of the spring.

5. An air hose reel apparatus, comprising:

a base having a recess;

an L-shaped support having a foot portion removably supported by said base and having spaced-apart walls at its other end portion;

tubular axle means journaled by said walls;

reel means including orthogonally disposed spokes secured to one end portion of said axle for angular rotation in a vertical plane when winding up or paying out an air hose;

each spoke of said spokes having a bifurcated end portion forming an outwardly open U-shape disposed transversely of the reel means vertical plane of rotation;

a first clip secured to the end portion of said axle projecting beyond said wall opposite said reel means;

a second clip secured to an intermediate portion of said axle adjacent but spaced from the wall adjacent said reel means;

a pair of friction washers respectively surrounding said axle on opposite sides of said wall opposite said reel means;

tension spring means surrounding said axle between said second clip and the adjacent said friction washer of said pair of friction washers for axially biasing said axle in the direction of said reel means and each washer of said pair of friction washers against opposite sides of said wall opposite said reel means for constant frictional resistance to free wheeling angular rotation of said axle and said reel means as a unit; and, coupling means secured to respective end portions of said axle for connection with a source of air under greater than atmospheric pressure.

* * * * *